US007390034B2

(12) United States Patent
Inoue

(10) Patent No.: US 7,390,034 B2
(45) Date of Patent: Jun. 24, 2008

(54) LATCH APPARATUS

(75) Inventor: Hisashi Inoue, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 110 days.

(21) Appl. No.: 10/949,241

(22) Filed: Sep. 27, 2004

(65) Prior Publication Data

US 2005/0099016 A1 May 12, 2005

(30) Foreign Application Priority Data

Nov. 12, 2003 (JP) ..... 2003-382564

(51) Int. Cl.
*E05C 3/06* (2006.01)

(52) U.S. Cl. ..... 292/10; 292/201; 292/DIG. 23

(58) Field of Classification Search ..... 292/10, 292/201, 216, 202, 218, DIG. 23
See application file for complete search history.

(56) References Cited

U.S. PATENT DOCUMENTS

| | | | | |
|---|---|---|---|---|
| 484,809 | A * | 10/1892 | McGuire | 238/195 |
| 5,639,130 | A * | 6/1997 | Rogers et al. | 292/216 |
| 6,053,542 | A * | 4/2000 | Ostrowski et al. | 292/201 |
| 6,123,372 | A * | 9/2000 | Rogers et al. | 292/216 |
| 6,550,825 | B2 * | 4/2003 | Ostrowski et al. | 292/199 |
| 6,666,483 | B2 * | 12/2003 | Baniak et al. | 292/123 |
| 6,764,113 | B1 * | 7/2004 | Cetnar | 292/201 |
| 6,848,727 | B1 * | 2/2005 | Cetnar et al. | 292/201 |
| 7,080,861 | B2 * | 7/2006 | Watanabe | 292/216 |

FOREIGN PATENT DOCUMENTS

| | | |
|---|---|---|
| JP | 62-146379 A | 6/1987 |
| JP | 02-096080 A | 4/1990 |
| JP | 6-212844 A | 8/1994 |
| JP | 11-324450 A | 11/1999 |

* cited by examiner

*Primary Examiner*—Patricia Engle
*Assistant Examiner*—Mark Williams
(74) *Attorney, Agent, or Firm*—Sughrue Mion, PLLC

(57) ABSTRACT

In a latch apparatus, a latch mechanism arranged at a vehicle body or a door, holds the door towards the vehicle body in a half closed state and a fully closed state. An open lever, a door opening action of which cancels the half closed state or the fully closed state of the door held by the latch mechanism, is arranged to be interlocked with the latch mechanism and to be able to swing. A first handle lever performs an opening action based on an opening operation of a first operation handle. A second handle lever performs an opening action based on an opening operation of a second operation handle. A cancel lever coupled to a closer apparatus that brings the door in the half closed state to the fully closed state, is caused to abut on the open lever to perform a canceling action, thereby disabling a drive of the closer apparatus.

4 Claims, 7 Drawing Sheets

LATCH APPARATUS

BACKGROUND OF THE INVENTION

1) Field of the Invention

The present invention relates to a latch apparatus for canceling a half closed state or a fully closed state of a door held by a latch mechanism.

2) Description of the Related Art

Conventionally, in a vehicle such as a four-wheel automobile, a latch apparatus provided in a slide door is provided with a latch mechanism, a handle lever and an open lever.

Japanese Patent Application Laid-open No. H6-212844 discloses a latch mechanism that holds a slide door to a vehicle body in a half closed state (a non-completely closed state) or a fully closed state (a completely closed state) through engagement with a striker provided on a side of the vehicle body. The handle lever performs an opening action based on an opening operation of an inside handle provided on an inside panel of the slide door, or an opening operation of an outside handle provided on an outside panel. The open lever performs a door opening action according to a door-opening operation of the handle lever, in an interlocking manner with the latch mechanism and cancels a half closed state or a fully closed state of the slide door that is held by the latch mechanism according to the door-opening operation.

However, in the latch apparatus, an opening action of the handle lever is performed in the following manner. A control unit interposed between the handle lever and the inside handle and the outside handle performs the opening action of the handle lever. The control unit is connected to an inside handle mechanism constituting the inside handle via an inside cable, and is also connected to an outside handle mechanism constituting the outside handle via an outside cable. The control unit is provided with a unit lever that swings via a return spring according to an opening operation of the inside handle, namely, a pulling action of the inside cable performed by the inside handle mechanism, and swings according to an opening operation of the outside handle, namely, a pulling action of the outside cable performed by the outside handle mechanism. The unit lever is always in a standby position due to biasing force of the return spring, but is swung against the biasing force of the return spring by a pulling action of the inside cable or a pulling action of the outside cable. The unit lever is coupled with the handle lever via a unit cable, and the handle lever performs an opening action according to swinging of the unit lever, i.e., a pulling action of the unit cable.

Therefore, for the handle lever to perform an opening action according to an opening operation of the inside handle, not only a pulling action of the inside cable but also a pulling action of the unit cable is required. Similarly, for the handle lever to perform an opening action according to an opening operation of the outside handle, not only a pulling action of the outside cable but also a pulling action of the unit cable is required. That is, for the handle lever to perform an opening action according to each of the opening action of the inside handle and the opening action of the outside handle, it is necessary to swing the unit lever against the biasing force of the return spring. Therefore, in order to cancel the half closed state or the fully closed state of the slide door held by the latch mechanism through the opening action of the handle lever and the door opening action of the open lever conducted by the opening operation of the inside handle and the opening operation of the outside handle, respectively, an excessive operating force is required.

SUMMARY OF THE INVENTION

It is an object of the present invention to at least solve the problems in the conventional technology.

A latch apparatus according to an aspect of the present invention includes a latch mechanism that is arranged at any one position of a vehicle body and a door, and that holds the door towards the vehicle body in a half closed state and a fully closed state; an open lever, a door opening action of which cancels the half closed state or the fully closed state of the door held by the latch mechanism, wherein the open lever is arranged to be interlocked with the latch mechanism and to be able to swing; a first handle lever that performs an opening action based on an opening operation of a first operation handle, to thereby abut on the open lever and cause the open lever to perform the door opening action; a second handle lever that performs an opening action based on an opening operation of a second operation handle, to thereby abut on the open lever and cause the open lever to perform the door opening action; and a cancel lever, which is coupled to a closer apparatus that brings the door in the half closed state to the fully closed state, and which is caused to abut on the open lever to perform a canceling action, thereby disabling a drive of the closer apparatus.

The other objects, features, and advantages of the present invention are specifically set forth in or will become apparent from the following detailed description of the invention when read in conjunction with the accompanying drawings.

DETAILED DESCRIPTION

Exemplary embodiments of a latch apparatus according to the present invention will be explained in detail with reference to the accompanying drawings. Note that the invention is not limited thereto.

Figure 1:
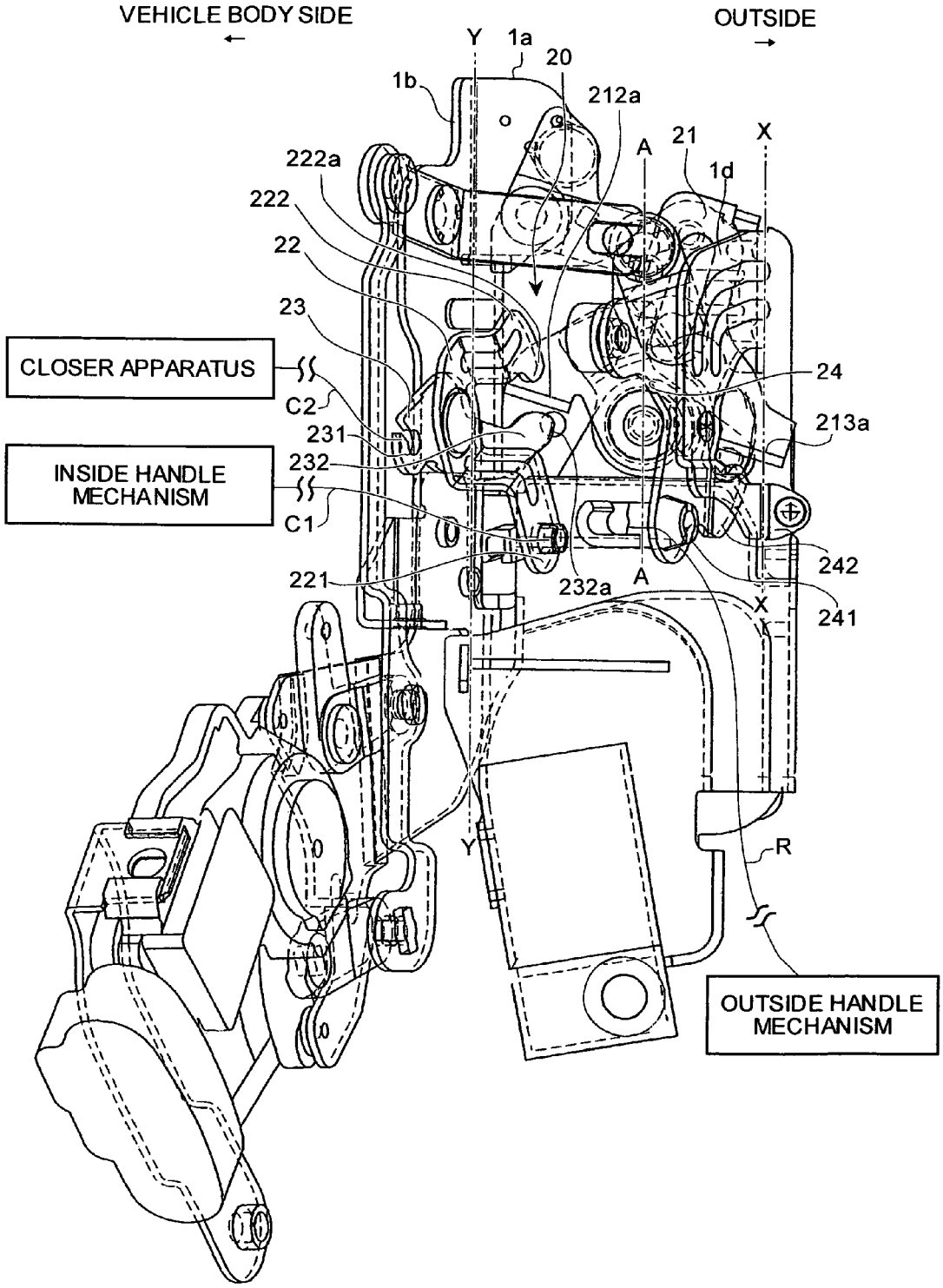
FIG. 1 is a perspective view of a latch apparatus according to an embodiment of the present invention.
Figure 2:
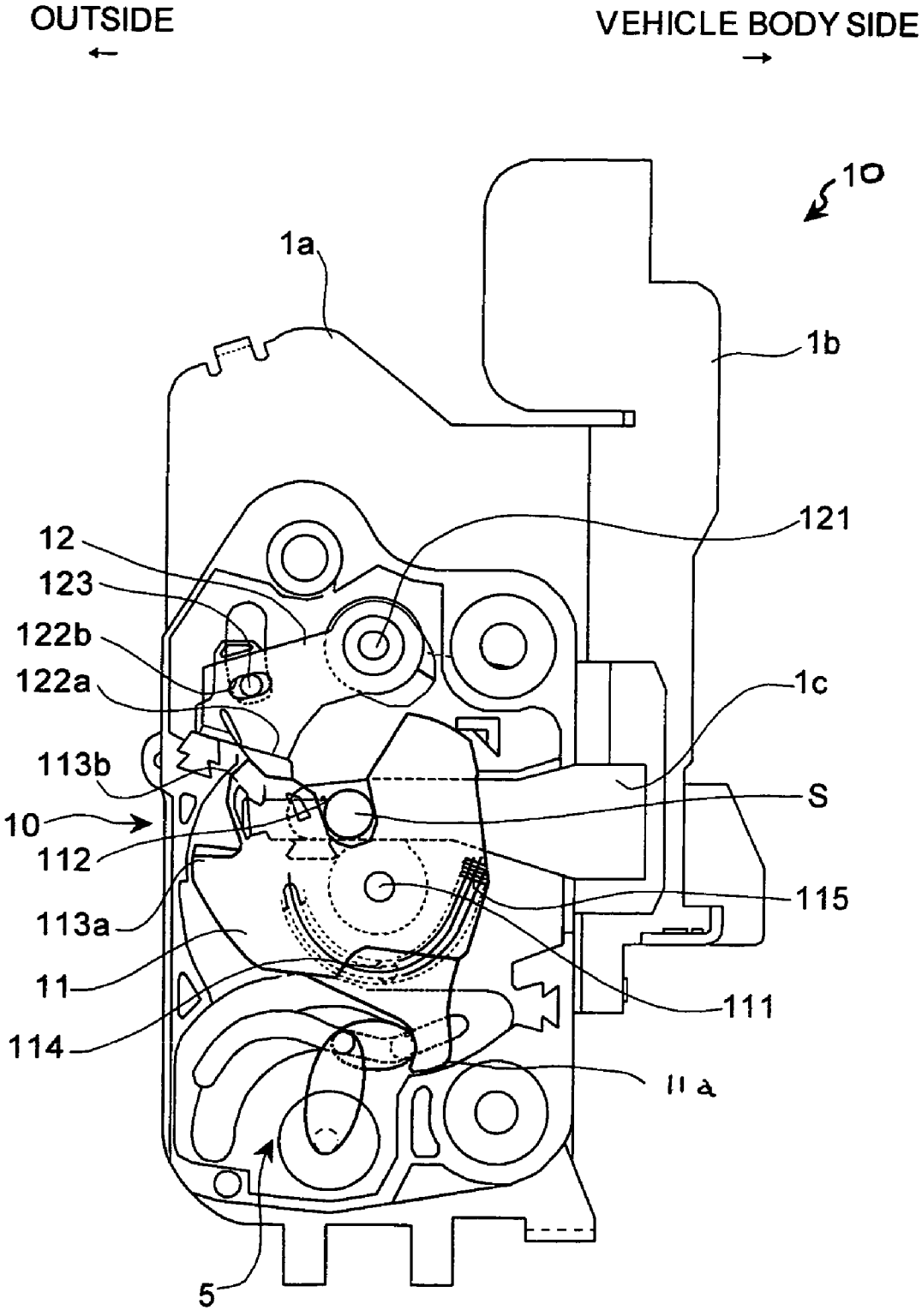
FIG. 2 is an explanatory view of the latch apparatus, as viewed from the back thereof.
Figure 3:
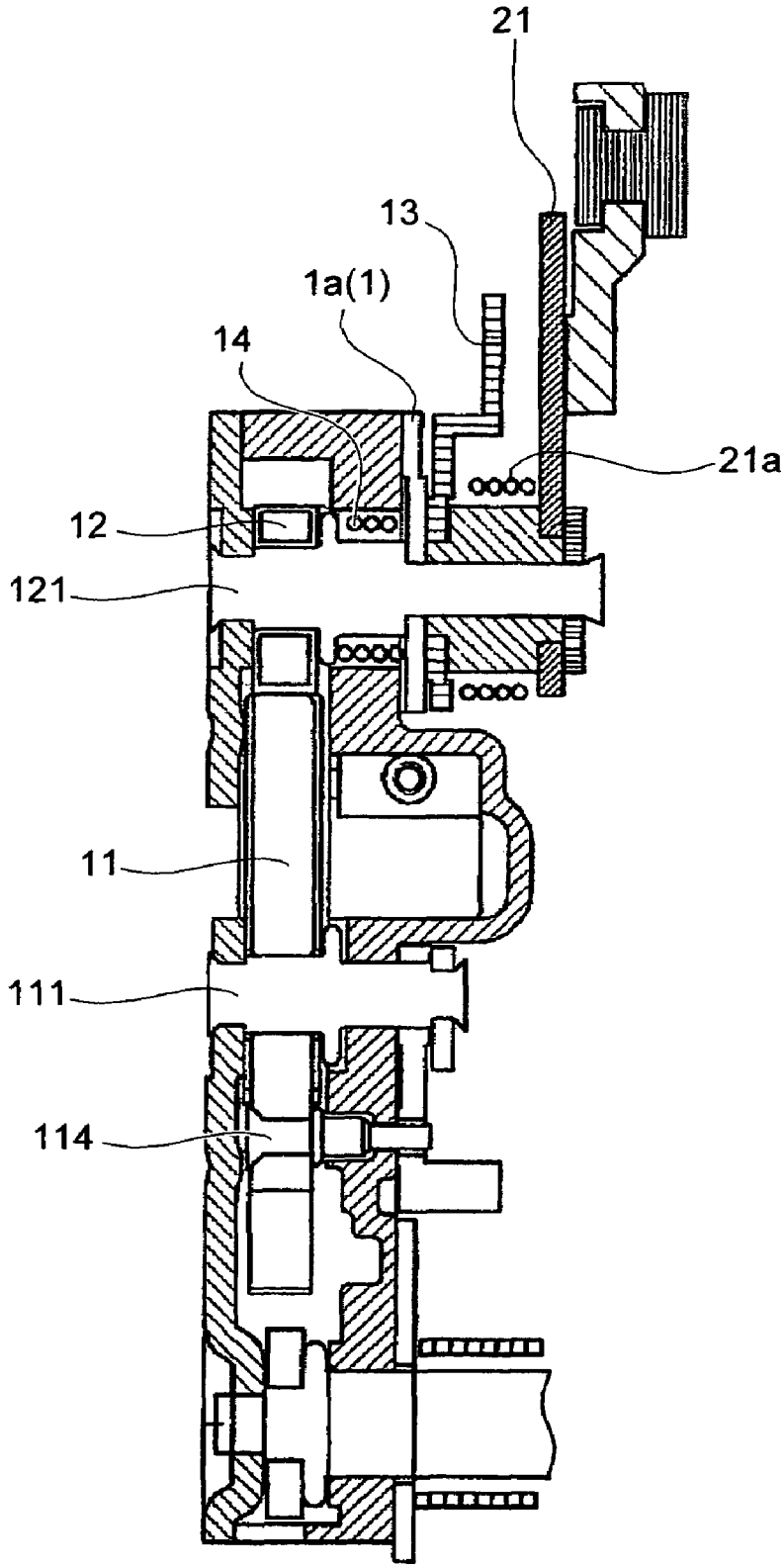
FIG. 3 is a sectional view of the latch apparatus, taken along a line A-A shown in FIG. 1.

Latch apparatuses are used for slide doors of vehicles. FIG. 1 is a perspective view of a latch apparatus according to an embodiment of the present invention, where a left side on the drawing denotes a vehicle body side and a right side thereon denotes a vehicle outside. FIG. 2 is a view of the latch apparatus shown in FIG. 1, as viewed from the back thereof, where a left side on the figure denotes the vehicle outside and a right side thereon denotes the vehicle body side. FIG. 3 is a sectional view of the latch apparatus, taken along a line A-A shown in FIG. 1.

The latch apparatus includes a latch mechanism 10 and a door opening mechanism 20. The latch mechanism 10 and the door opening mechanism 20 are arranged on a common base plate 1. The base plate 1 is a metal plate, is bent to constitute obtuse angles, and it has a first base plate 1*a* extending outward, and a second base plate 1*b* positioned on a vehicle body side. As shown in FIG. 2, the first base plate 1*a* is formed generally at a central position thereof in a vertical direction, with a horizontal notched groove 1*c* extending generally horizontally outward from the vehicle body side.

The latch mechanism 10 retains a meshing state with a striker S provided on the vehicle body side, like the conventional art, and is provided with a latch 11 and a ratchet 12.

The latch 11 is arranged at a position below the horizontal notched groove 1*c*, and can swing about an axial center of a latch shaft 111 extending generally horizontally along a longitudinal direction of the vehicle. The latch 11 has a groove 112 and two pawls 113*a* and 113*b*. The groove 112 is formed so as to extend from an outer peripheral face of the latch 11 toward the latch shaft 111, and has a width allowing reception of the striker S.

A latch pin 114 disposed below the latch 11 is caused to abut on a latch spring 115 to keep the latch 11 always biased by biasing force of the latch spring 115 in a clockwise direction.

The ratchet 12 is arranged at a position above the horizontal notched groove 1*c*, can swing about an axial center of a ratchet shaft 121 extending generally horizontally along the longitudinal direction of the vehicle, and has an engaging pawl 122*a* and a supporting hole 122*b*.

The engaging pawl 122*a* extends outward from the ratchet shaft 121 in a diametrically outward direction. The engaging pawl 122*a* can be engaged with either one of the pawls 113*a* and 113*b* via an end face thereof, when the ratchet 12 is swung in a counterclockwise direction.

The supporting hole 122*b* is provided above the engaging pawl 122*a*. The ratchet 12 is coupled to a ratchet lever 13 via a coupling pin 123 (see FIGS. 2 and 3) received in the supporting hole 122*b*. The ratchet lever 13 is provided on a surface side of the first base plate 1*a*, and swings about the axial center of the ratchet shaft 122. That is, the ratchet 12 and the ratchet lever 1 3 swing about the axial center of the ratchet shaft 121 integrally. A ratchet spring 14 that always biases the ratchet 12 and the ratchet lever 13 in a counterclockwise direction on FIG. 2 is provided between the ratchet 12 and the ratchet lever 13.

The door opening mechanism 20 is provided on a surface side of the base plate 1, and it is provided with an open lever 21, an inside handle lever (a first handle lever) 22, a cancel lever 23, and an outside handle lever (a second handle lever) 24.

Figure 4:
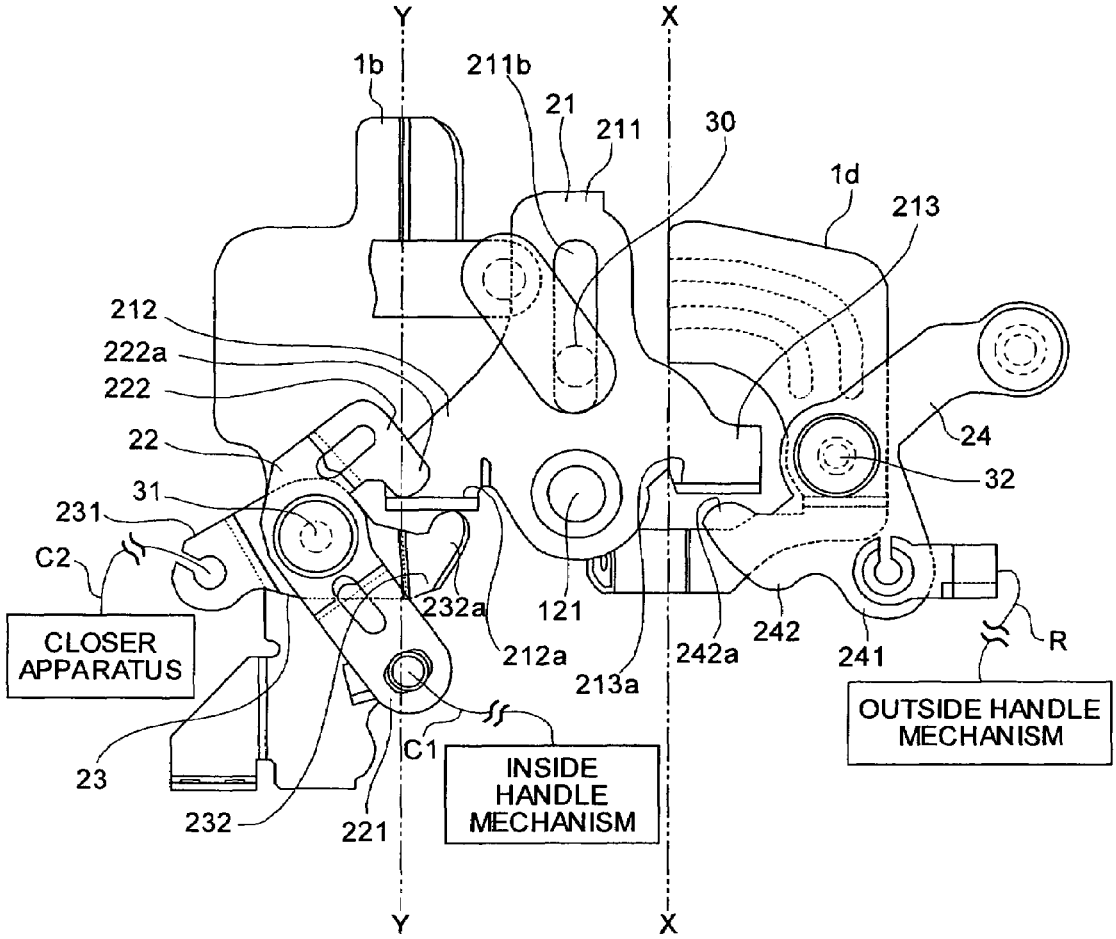
FIG. 4 is an explanatory view of the development of regions that are shown with a two-dotted chain line X-X and a two-dotted chain line Y-Y in FIG. 1.

FIG. 4 is an explanatory view of the development of regions that are shown with a two-dotted chain line X-X and a two-dotted chain line Y-Y in FIG. 1. The open lever 21 is supported to swing about an axial center of the ratchet shaft 121. More specifically, the open lever 21 is supported to swing about an axial center of the ratchet shaft 121 via an open lever spring 21*a* (see FIG. 3), and is always biased in a clockwise direction by a biasing force of the open lever spring 21*a*. The open lever spring 21*a* has a serving unit 211, a first abutting unit 212 and a second abutting unit 213.

The serving unit 211 extends from the ratchet shaft 121 upward in a diametrically outward direction, and is formed at a central region thereof with an elongated hole 211*b*. The elongated hole 211*b* receives a boss 30 interlocked with a lock mechanism (not shown) for putting the latch mechanism 10 in a locked state or in an unlocked state. The boss 30 is received in a lower portion of the elongated hole 211*b*, namely, on a side of approaching to the ratchet shaft 121, in the unlocked state, and is received in-an upper portion of the elongated hole 211*b*, namely, on a side of separating from the ratchet shaft 121, in the locked state. When received in the elongated hole 211*b* on the side of approaching to the ratchet shaft 121, the boss 30 abuts on the ratchet lever 13 due to swinging of the open lever 21 to swing and press the ratchet lever 13, as described later. On the other hand, when received in the elongated hole 211*b* on the side of separating from the ratchet shaft 121, the boss 31 does not abut on the ratchet lever 13 even when the open lever 21 swings.

The first abutting unit 212 extends from the ratchet shaft 121 toward the vehicle body in a diametrically outward direction, and has a first abutting piece 212*a* caused to abut on the inside handle lever 22. The second abutting unit 213 extends outward from the ratchet shaft 121 in a diametrically outward direction, and has a second abutting piece 213*a* caused to abut on the outside handle lever 24.

The inside handle lever 22 is arranged to swing about an axial center of a first lever shaft 31 disposed on the second base plate 1*b*, and has a base 221 and an abutting unit 222.

The base 221 extends from the first lever shaft 31 rightward and obliquely downward and in a diametrically outward direction, and is directly or indirectly connected to an inside handle mechanism constituting an inside handle via a first cable C1. If necessary, a control unit that performs control of a child lock, which disables an opening operation of the inside handle, may be interposed between the inside handle lever 22 and the inside handle mechanism. When the inside handle is operated for opening, the inside handle mechanism draws the first cable C1.

The abutting unit 222 extends from the first lever shaft 31 obliquely rightward and upward in a diametrically outward direction, and has an abutting projection 222*a* that abuts on the first abutting piece 212*a* of the open lever 21.

The cancel lever 23 is arranged to swing about an axial center of the first lever shaft 31 in a sandwiching manner between the second base plate 1*b* and the inside handle lever 22, and has a base 231 and a to-be-abutted unit 232.

The base 231 extends from the first lever shaft 31 leftward in a diametrically outward direction, and is connected to a closer apparatus via a second cable C2. The closer apparatus causes the latch mechanism 10 to perform a closing operation to achieve a fully latched state when the latch mechanism 10 is put in a half latched state. Specifically, the base 11*a* of the latch 11 is pressed by a latch pressing mechanism 5 (refer to FIG. 5) and the latch 11 is swung (caused to perform an closing operation) in a counterclockwise direction on FIG. 5 against the biasing force of the latch spring 115, so that the latch mechanism 10 is put in a fully latched state. The base 231 will be explained in detail next. The base 231 is connected to a disabling lever (not shown) of the closer apparatus via the second cable C2. The disabling lever disables driving of the latch pressing mechanism 5 conducted by the closer apparatus via swinging of the disabling lever itself.

The to-be-abutted unit 232 extends from the first lever shaft 31 rightward in a diametrically outward direction (see FIG. 4), and it has a to-be-abutted piece 232*a* on which the first abutting piece 212*a* of the open lever 21 is caused to abut.

A relative positional relationship between the inside handle lever 22 and the cancel lever 23 is determined in an ordinary state in an aspect that the abutting projection 222*a* and the to-be-abutted piece 232*a* sandwiches the first abutting piece 212*a* of the open lever 21.

The outside handle lever 24 is arranged to swing about an axial center of a second lever shaft 32 arranged on a supporting plate 1*d*. More specifically, the supporting plate 1*d* is obtained by bending the first base plate 1*a*, and is positioned opposite to the second base plate 1*b*. The outside handle lever 24 is arranged to swing about an axial center of the second lever shaft 32 that is formed to project from a face opposite to the second base plate 1*b* of the supporting plate 1*d*, and has a base 241 and an abutting unit 242. That is, the outside handle lever 24 is arranged at a position approximately opposite to the inside handle lever 22 and the cancel lever 23.

The base 241 extends from the second lever shaft 32 downward in a diametrically outward direction on FIG. 4, and is directly connected to an outside handle mechanism that constitutes the outside handle, via a rod R. The outside handle mechanism operates to push out the rod R, when the outside handle is operated for opening.

The abutting unit 242 extends from the second lever shaft 32 obliquely leftward and downward in a diametrically outward direction, and has an abutting projection 242*a* for abutting on a second abutting piece 213*a* of the open lever 21.

The latch apparatus with the above constitution performs the following action. For convenience of explanation, the slide door will be explained in its unlocked state, namely in a state that the boss 30 is received in the elongated hole 211*b* on the side of approaching to the ratchet shaft 121.

When the slide door is moved for closing, the striker S on the vehicle body side relatively advances into the groove 112 of the latch 11 to abut on the latch 11 in the latch mechanism 10, so that the latch 11 is swung against the biasing force of the latch spring 115. As a result, a fully latched state where the engaging pawl 122*a* of the ratchet 12 is engaged with the pawl 113*b* of the latch 11 is achieved, as shown in FIG. 2. At this time, the slide door is in a fully closed state with respect to the vehicle body.

Figure 6:
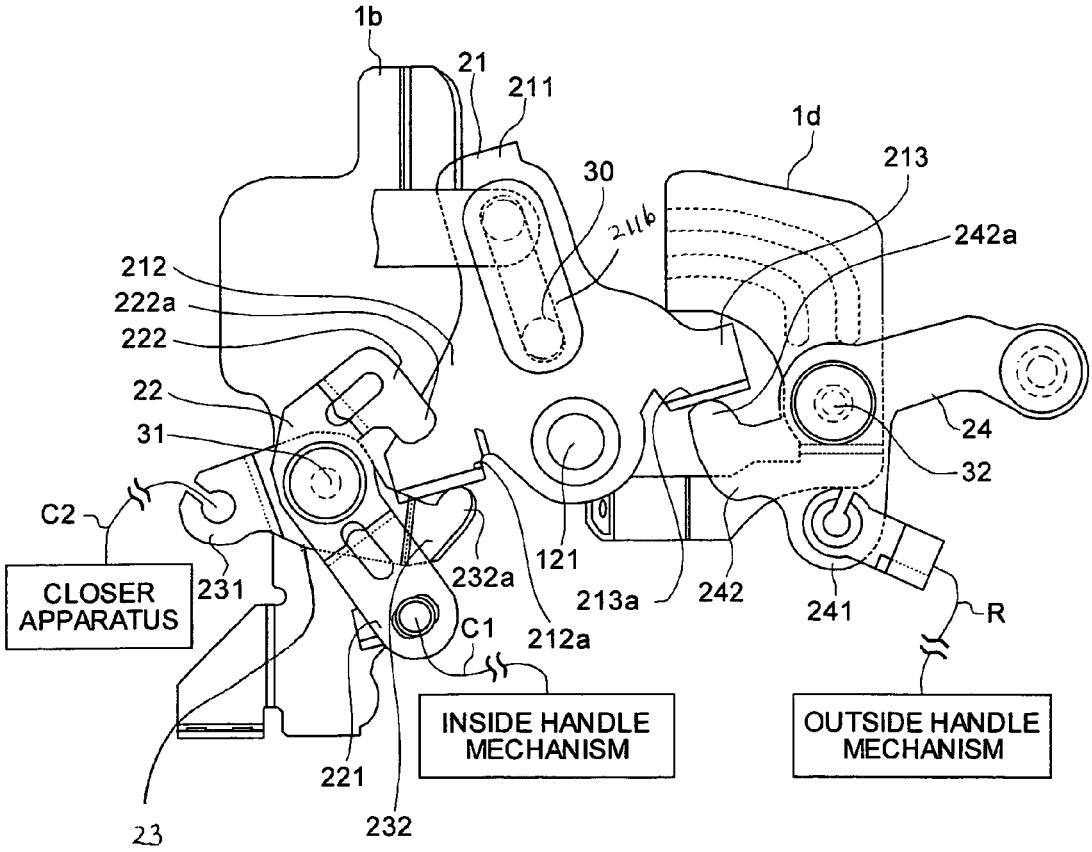
FIG. 6 is a second explanatory view of the development of the regions shown with the two-dotted chain line X-X and the two-dotted chain line Y-Y in FIG. 1.

When the latch mechanism 10 is in the fully latched state (the state shown in FIG. 2), the outside handle mechanism performs a pushing-out action of the rod R according to an opening operation of the outside handle. Consequently, the outside handle lever 24 is swung in a clockwise direction in FIG. 6 (performs an opening action). When the outside handle lever 24 performs the opening action in this manner, the abutting unit 242*a* of the outside handle lever 24 abuts on the second abutting piece 213*a* of the open lever 21, so that the open lever 21 is also swung in a counterclockwise direction, as shown in FIG. 6, against the biasing force of the open lever spring 21*a* (performs an opening action). When the open lever 21 performs the door opening action, the boss 30 received in the elongated hole 211*b* abuts on the ratchet lever 13 to push the same, so that the ratchet lever 13 and the ratchet 12 is swung in a clockwise direction on FIG. 2 against the biasing force of the ratchet spring 14. As a result, the engaging pawl 122*a* of the ratchet 12 and the pawl 113*b* of the latch 11 are disengaged from each other, and the latch 11 is swung in a clockwise direction in FIG. 2 by the biasing force of the latch spring 115, so that the slide door can be moved for opening.

Figure 7:
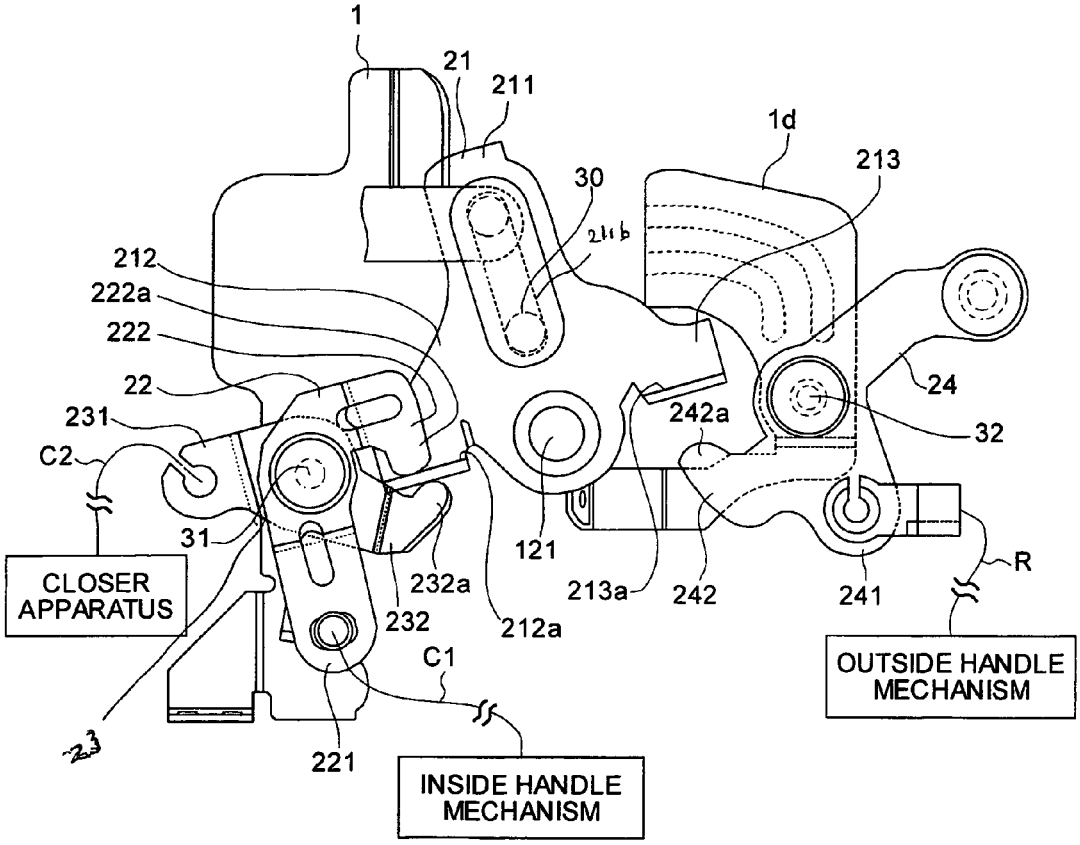
FIG. 7 is a third explanatory view of the development of the regions shown with the two-dotted chain line X-X and the two-dotted chain line Y-Y in FIG. 1.

On the other hand, when the latch mechanism 10 is in a fully latched state, the inside handle mechanism performs a pulling action of the first cable C1 according to an opening operation of the inside handle. As a result, the inside handle lever 22 is swung in a clockwise direction on FIG. 7 (performs an opening action). When the inside handle lever 22 performs the opening action in this manner, the abutting projection 222*a* of the inside handle lever 22 abuts on the first abutting piece 212*a* of the open lever 21, so that the open lever 21 is also swung in a counterclockwise direction as shown in FIG. 7 against the biasing force of the open lever spring 21*a* (performs an door opening action). When the open lever 21 performs the door opening action, the boss 30 received in the elongated hole 211*b* abuts on the ratchet lever 13 to press the same, so that the ratchet lever 13 and the ratchet 12 are swung in a clockwise direction on FIG. 2 against the biasing force of the ratchet spring 14. As a result, the engaging pawl 122*a* of the ratchet 12 and the pawl 113*b* of the latch 11 are disengaged from each other, and the latch 11 is swung in a clockwise direction on FIG. 2 by the biasing force of the latch spring 115, so that the slide door can be moved for opening.

Figure 5:
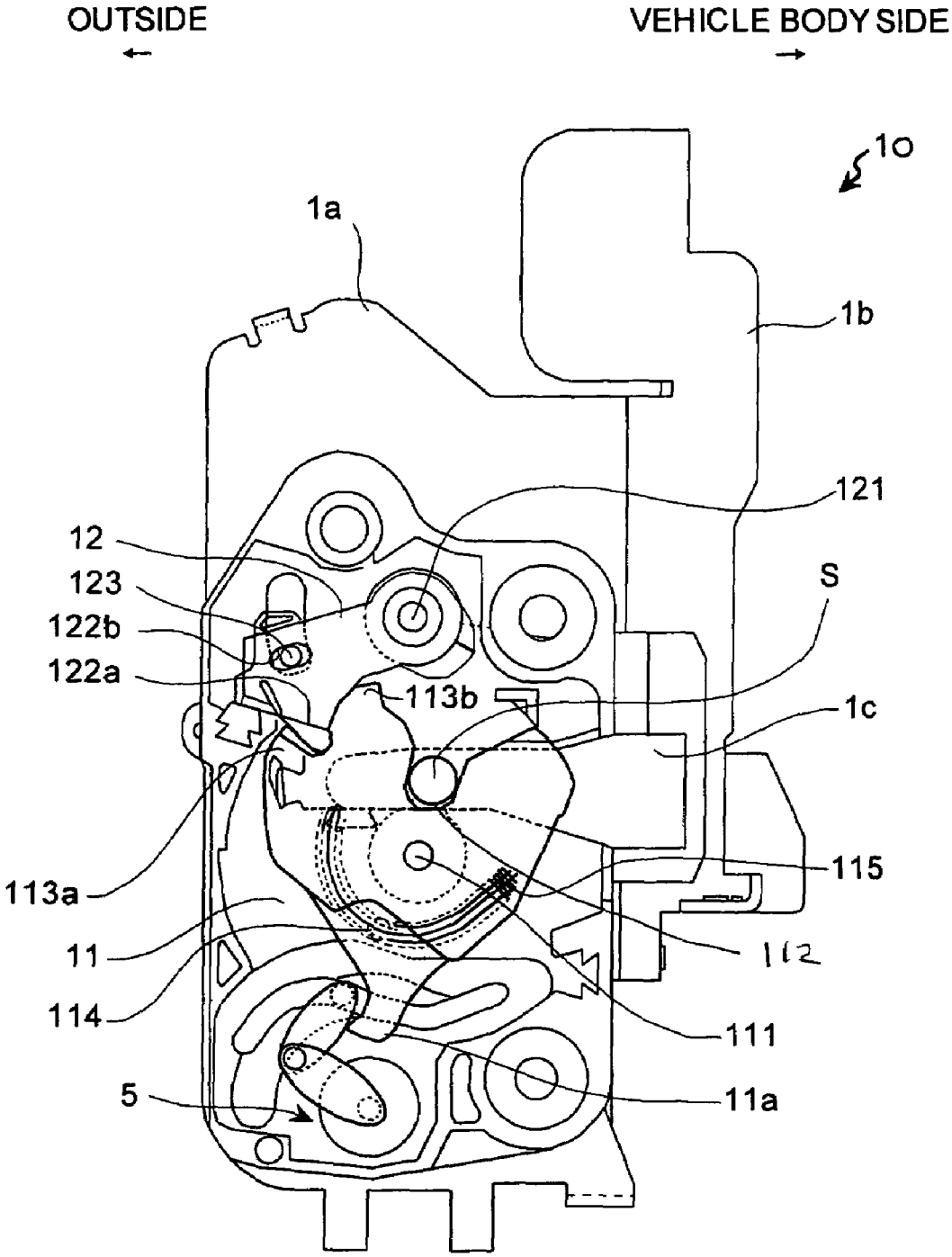
FIG. 5 is another explanatory view of the latch apparatus, as viewed from the back thereof.

When the slide door is moved for closing, the striker S on the vehicle body side relatively advances into the groove 112 of the latch 11 to abut on the latch 11 in the latch mechanism 10, so that the latch 11 is swung against the biasing force of the latch spring 115. However, when a swinging amount of the latch 11 is small due to such a cause that a force required for closing movement of the slide door is weak, a half latched state that the engaging pawl 122*a* of the ratchet 12 and the pawl 113 of the latch have been engaged with each other occurs, as shown in FIG. 5. At this time, the slide door is put in a half closed state to the vehicle body. When the latch mechanism 10 falls in the half latched state in this manner, the closer apparatus acts to cause the latch mechanism 10 to perform a closing action to achieve a fully latched state.

When the latch mechanism 10 is performing the closing action from the half latched state to the fully latched state, the outside handle mechanism performs a pushing-out action of the rod R according to an opening operation of the outside handle. As a result, the outside handle lever 24 is swung in a clockwise direction on FIG. 6 (performs an opening action). When the outside handle lever 24 performs an opening action in this manner, an abutting unit 242*a* of the outside handle lever 24 abuts on a second abutting piece 213*a* of the open lever 21, so that the open lever 21 is also swung in a counterclockwise direction as shown in FIG. 6 against the biasing force of the open lever spring 21*a* (performs a door opening action). When the open lever 21 performs the door opening action, the to-be-abutted unit 232*a* of the cancel lever 23 is caused to abut on the first abutting piece 212*a* of the open lever 21, so that the cancel lever 23 is swung in a clockwise direction on FIG. 6 (performs a canceling action). When the cancel lever 23 performs the canceling action, the second cable C2 is subjected to a pulling action so that the disabling lever of the closer apparatus is actuated. Thereby, driving of the closer apparatus, namely drive for pressing the base 11*a* of the latch 11 by the latch pressing mechanism 5 to put the latch mechanism 10 in a fully latched state can be disabled.

When the open lever 21 performs a door opening action, the boss 30 received in the elongated hole 211*b* on the side of approaching to the ratchet shaft 121 abuts on the ratchet lever 13 to press the same, so that the ratchet lever 13 and the ratchet 12 are swung in a clockwise direction on FIG. 5 against the biasing force of the ratchet spring 14. As a result, the engaging pawl 122*a* of the ratchet 12 and the pawl 113*a* of the latch 11 are disengaged from each other, and the latch 11 is swung in a clockwise direction on FIG. 5 by the biasing force of the latch spring 115, so that the slide door can be moved for opening.

On the other hand, when the latch mechanism 10 is performing a closing action from a half latched state to a fully latched state, the inside handle mechanism performs a pulling action of the first cable C1 according to an opening operation of the inside handle. Consequently, the inside handle lever 22 is swung in a clockwise direction on FIG. 7 (performs an opening action). When the inside handle lever 22 performs the opening action in this manner, the abutting projection 222*a* of the inside handle lever 22 abuts on the first abutting piece 212*a* of the open lever 21, so that the open lever 21 is also swung in a counterclockwise direction as shown in FIG. 7 against the biasing force of the open lever spring 21*a* (performs a door opening action). When the open lever 21 performs the door opening action, the to-be-abutted piece 232*a* of the cancel lever 23 is caused to abut on the first abutting piece 212*a* of the open lever 21, so that the cancel lever 23 is swung in a clockwise direction on FIG. 7 (performs a canceling action). When the cancel lever 23 performs the canceling action, the second cable C2 performs a pulling action to actuate the disabling lever of the closer apparatus. Thereby, driving of the closer apparatus, namely drive for pressing the base 11*a* of the latch 11 by the latch pressing mechanism 5 to put the latch mechanism 10 in a fully latched state can be disabled.

When the open lever 21 performs a door opening action, the boss 30 received in the elongated hole 211*b* on the side of approaching to the ratchet shaft 121 abuts on the ratchet lever 13 to press the same, so that the ratchet lever 13 and the ratchet 12 are swung in a clockwise direction on FIG. 5 against the biasing force of the ratchet spring 14. As a result, the engaging pawl 122*a* of the ratchet 12 and the pawl 113*a* of the latch 11 are disengaged from each other, so that the latch 11 is swung in a clockwise direction on FIG. 5 by the biasing force of the ratchet spring 115, so that the slide door can be moved for opening.

As described above, in the latch apparatus according to the embodiment of the invention, the inside handle lever 22 performs an opening action based on an opening operation of the inside handle to abut on the open lever 21 and cause the open lever 21 to perform a door opening action. Further, the outside handle lever 24 performs an opening action based on an opening operation of the outside handle to abut on the open lever 21 and cause the open lever 21 to perform a door opening action. Therefore, the conventional common cable pulling operation is not required. Accordingly, an operating force applied to the inside handle and the outside handle, required for canceling of the half closed state or the fully closed state of the slide door held by the latch mechanism 10, reduces.

According to the latch mechanism 10, the opening action of the outside handle lever 24 can be performed directly based on the opening operation of the outside handle via the rod R. Therefore, the opening action of the outside handle lever 24 can be performed more reliably as compared with a case when an opening action is performed via a plurality of members.

According to the latch mechanism 10, the inside handle lever 22 and the outside handle lever 24 are respectively connected to the inside handle mechanism and the outside handle mechanism via the coupling units (the cable and the rod). Therefore, it is unnecessary to provide a complicated mechanism, and the whole apparatus can be simplified.

The exemplary embodiments of the present invention have been explained above. However, the invention is not limited to the embodiments and may be applied with various modifications. For example, it has been explained above that the inside handle lever 22, the cancel lever 23, and the outside handle lever 24 are respectively connected to the inside handle mechanism, the closer apparatus and the outside handle mechanism via the cables C1, C2, and the rod R. However, these levers may be connected to the inside handle mechanism, the closer apparatus, and the outside handle mechanism respectively, via link mechanisms.

According to the latch apparatus of the present invention, pulling actions of a common lever and a common cable are not required, and an operation force required for canceling the half closed state and the fully closed state of the door held by the latch mechanism reduces.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A latch apparatus comprising:

a latch mechanism that is arranged at any one of a vehicle body and a door, and that holds the door towards the vehicle body in a half closed state and a fully closed state, wherein the latch mechanism includes a ratchet swingable about an axial center of a ratchet shaft;

an open lever operative to perform a door opening action, said action being operative to cancel the half closed state or the fully closed state of the door held by the latch mechanism, wherein the open lever is arranged to be interlocked with the latch mechanism and is supported to swing about the axial center of the ratchet shaft;

a first handle lever that performs an opening action based on an opening operation of a first operation handle, to thereby abut on the open lever and cause the open lever to perform the door opening action;

a second handle lever that performs an opening action based on an opening operation of a second operation handle, to thereby abut on the open lever and cause the open lever to perform the door opening action; and a cancel lever, which is coupled to a closer apparatus that brings the door in the half closed state to the fully closed state, said cancel lever being operative to abut on the open lever to perform a canceling action, thereby disabling a drive of the closer apparatus.

2. A latch apparatus, comprising:

a latch mechanism that is arranged at any one of a vehicle body and a door, and that holds the door towards the vehicle body in a half closed state and a fully closed state;

an open lever operative to perform a door opening action, said action being operative to cancel the half closed state or the fully closed state of the door held by the latch mechanism, wherein the open lever is arranged to be interlocked with the latch mechanism and to be able to swing;

a first handle lever that performs an opening action based on an opening operation of a first operation handle, to thereby abut on the open lever and cause the open lever to perform the door opening action;

a second handle lever that performs an opening action based on an opening operation of a second operation handle, to thereby abut on the open lever and cause the open lever to perform the door opening action; and a cancel lever, which is coupled to a closer apparatus that brings the door in the half closed state to the fully closed state, said cancel lever being operative to abut on the open lever to perform a canceling action, thereby disabling a drive of the closer apparatus, wherein the first handle lever and the cancel lever are coaxially and rotatably supported by a same supporting shaft which pivotally supports the cancel lever to allow the canceling action, and which pivotally supports the first handle lever to allow the opening action.

3. A latch apparatus, comprising:

a latch mechanism that is arranged at any one of a vehicle body and a door, and that holds the door towards the vehicle body in a half closed state and a fully closed state;

an open lever operative to perform a door opening action, said action being operative to cancel the half closed state or the fully closed state of the door held by the latch mechanism, wherein the open lever is arranged to be interlocked with the latch mechanism and to be able to swing;

a first handle lever that performs an opening action based on an opening operation of a first operation handle, to thereby abut on the open lever and cause the open lever to perform the door opening action;

a second handle lever that performs an opening action based on an opening operation of a second operation handle, to thereby abut on the open lever and cause the open lever to perform the door opening action; and a cancel lever, which is coupled to a closer apparatus that brings the door in the half closed state to the fully closed state, said can lever being open to abut on the open lever to perform a canceling action, thereby disabling a drive of the closer apparatus, wherein the first handle lever and the cancel lever sandwich an abutting piece of the open lever therebetween.

4. A latch apparatus, comprising:

a latch mechanism that is arranged at any one of a vehicle body and a door, and that holds the door towards the vehicle body in a half closed state and a fully closed state;

an open lever operative to perform a door opening action, said action being operative to cancel the half closed state or the fully closed state of the door held by the latch mechanism, wherein the open lever is arranged to be interlocked with the latch mechanism and to be able to swing;

a first handle lever that performs an opening action based on an opening operation of a first operation handle, to thereby abut on the open lever and cause the open lever to perform the door opening action;

a second handle lever that performs an opening action based on an opening operation of a second operation handle, to thereby abut on the open lever and cause the open lever to perform the door opening action; and a cancel lever, which is coupled to a closer apparatus that brings the door in the half closed state to the fully closed state, said cancel lever being operative to abut on the open lever to perform a canceling action, thereby disabling a drive of the closer apparatus, wherein the open lever swings about a shaft, the open lever has a first abutting piece which is capable of being abutted by the first handle lever and the cancel lever, and the open lever has a second abutting piece which is capable of being abutted by the second handle lever, wherein the first abutting piece and the second abutting piece are positioned approximately opposite to each other on the open lever with respect to the shaft.

* * * * *